US006174233B1

(12) United States Patent
Sunaga et al.

(10) Patent No.: US 6,174,233 B1
(45) **Date of Patent: *Jan. 16, 2001**

(54) GAME MACHINE

(75) Inventors: Isao Sunaga; Hiroyuki Danjo; Yukinori Inamura, all of Tokyo (JP)

(73) Assignee: Universal Sales Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/971,601

(22) Filed: Nov. 17, 1997

Related U.S. Application Data

(63) Continuation-in-part of application No. 08/919,016, filed on Aug. 27, 1997.

(51) Int. Cl.[7] ..... A63F 5/04
(52) U.S. Cl. ..... 463/20; 463/22; 463/25
(58) Field of Search ..... 273/143 R; 463/20, 463/19, 18, 17, 16

(56) References Cited

U.S. PATENT DOCUMENTS

| | | | | |
|---|---|---|---|---|
| 4,618,150 | | 10/1986 | Kimura | 273/143 |
| 4,718,672 | | 1/1988 | Okada | 273/143 |
| 4,871,171 | * | 10/1989 | Rivero | 273/138.1 |
| 4,993,713 | | 2/1991 | Harada | 273/138 |
| 5,010,995 | | 4/1991 | Okada | 194/219 |
| 5,018,737 | * | 5/1991 | Okada | 273/143 R |
| 5,024,439 | * | 6/1991 | Okada | 273/143 R |
| 5,074,559 | * | 12/1991 | Okada | 463/21 |
| 5,083,785 | * | 1/1992 | Okada | 463/21 |
| 5,127,651 | | 7/1992 | Okada | 273/143 |
| 5,609,524 | * | 3/1997 | Inoue | 463/20 |
| 5,695,188 | | 12/1997 | Ishibashi | 273/143 |
| 5,890,962 | * | 4/1999 | Takemoto | 463/20 |

FOREIGN PATENT DOCUMENTS

| | | | | |
|---|---|---|---|---|
| 414427 | * | 2/1991 | (EP) | 27/138 A |

* cited by examiner

*Primary Examiner*—Joe H. Cheng
*Assistant Examiner*—John M. Hotaling, II
(74) *Attorney, Agent, or Firm*—Hutchins, Wheeler & Dittmar

(57) ABSTRACT

In a game machine, game result conditions may be randomly selected for a predetermined number of games among a plurality of given game result conditions and a demonstration may be made to provide a player of the game with a feeling of higher probability of winning a prize in the game when the randomly selected game result conditions include a given specific game result condition. The demonstration may be made by a variety of possible techniques, including using a flashing light or changing the volume or tone of a sound. Random numbers may be sampled in advance for random selection of game result conditions for the current game and for one or more games that will follow the current game, i.e., ranging several games down from the current game. These random numbers may be used to determine whether or not a demonstration should be made in the current game. As a result, more games will have demonstrations than in existing games, in which only the current games status can be considered, and more effective demonstrations may be made to enhance a player's interest in playing more games. The present invention is a game machine that randomly selects the game result conditions of a first game by lottery from among a plurality of conditions, and that determines the game results on the basis of the randomly selected results, wherein the player is alerted by a presentation to the fact that a "Second Game Win" condition exists among randomly selected conditions.

37 Claims, 12 Drawing Sheets

GAME MACHINE

CROSS-REFERENCE TO RELATED APPLICATIONS

This application is a continuation in part of U.S. patent application titled "Game Machine," Ser. No. 08/919,016, filed Aug. 27, 1997, pending, the contents of which are hereby incorporated by reference.

FIELD OF THE INVENTION

The present invention relates to the field of game machines, and more particularly to the field of game machines such as slot machines in which unusual lighting, sounds, or any other similar indicator signals that a player may most likely win a prize.

BACKGROUND

Game machines, such as slot machines and poker game machines, that pay back tokens, such as coins, for winning game results have been very popular. Here, slot machines will be used as an example of a game machine.

Players start a game by pulling a start lever after putting a token in the slot machine. A plurality (three, for example) of reels with numerous types of symbols arranged on the circumference rotate at high speed in the slot machine, and the prize status is determined by the combination of the symbols on the reels displayed at a given location in a window when the reels have stopped. The number of tokens that are paid out is determined by the combination of symbols when the reels have stopped, that is, the prize status. When the current game prize status has been determined, the reels are rotated to begin the game.

Slot machine prizes typically include "Big Jackpots," where 1000 or more tokens, for example, are paid back, as well as "Small Jackpots," where less than 1000 tokens are paid back. A variety of other prizes also may be offered.

In most slot machines, the player can operate stop buttons provided in the slot machine to stop the reels, but in the type of slot machine in which the prize status is determined by random selection using random numbers for each game, the reels are not stopped immediately when the player actuates the stop buttons, but instead are stopped when the symbols on the reels reach the position corresponding to the prize status previously determined by random selection.

It is possible for too much time to pass after the player presses the stop buttons until the reels stop at the prize status that had been previously determined by random selection. This could lead to unnatural reel-stopping operations. In such cases, the reels may be stopped at a point that does not match the prize status previously determined by random selection. In other words, when too much time passes until the reels stop after the player has operated the stop bottons, leading to unnatural reel-stopping operations, the reels are stopped irrespective of the prize status previously determined by random selection. As a result, even when the prize status previously determined by random selection would have been, for example, a "Big Jackpot," the prize status may end up being a "Lose" due to the timing with which the player has actuated the stop buttons. Conversely, when the prize status previously determined by random selection would have been a "Lose," the prize status may end up being a "Big Jackpot" due to the circumstances under which the player actuated the stop buttons.

Slot machine prizes also may include a so-called "Second Game Win" result, where a second game can be played as a subsidiary game. This "Second Game Win" result is described below.

The game that results in the aforementioned "Big Jackpot," "Small Jackpot," or "Second Game Win" is referred to herein as the first game. When a "Second Game Win" is won in a first game, a second game can be played without new tokens being entered. The second game is played with an arrangement or a set of beginning reels that is different from the arrangement or set of the first game. Common examples are referred to as "Bonus" games or "Free" games. Such a second game is often advantageous for the player, allowing the player to win a prize that includes a large amount of tokens depending on the results of the second game. The player plays the slot machine in anticipation of increasing the number of tokens in possession, but since the number of tokens in the player's possession does not increase all that much with "Small Jackpots," the player plays the slot machine while hoping for a "Second Game Win" or a "Big Jackpot" that will quickly increase the number of tokens in the player's possession.

Frequently, the prize status in a slot machine is determined by random selection using random numbers for each game. In this type of slot machine, for example, the prize status is randomly selected when a token is put into the slot machine and the start lever is pulled, and the current game prize status is then determined. When the current game prize status has been determined, the reels are rotated to begin the game.

However, in the type of slot machine in which the prize status is determined by random selection using random numbers for each game, the prize status is randomly selected when a token has been put into the slot machine and the start lever has been pulled, so the prize status of the current game is already known when the reels begin to rotate. As described above, the player plays slot machines hoping for a "Second Game Win" or "Big Jackpot" to quickly increase the number of tokens in the player's possession, and when it is known that there is an extremely high possibility that the current game will result in a "Big Jackpot" or "Second Game Win" as a result of previous random selection (as described previously, there can be cases in which the prize status might end up as a "Lose" due to the timing with which the player actuates the stop buttons), it would be extremely significant to make a demonstration alerting the player to that fact.

SUMMARY OF THE INVENTION

The systems and methods described herein are designed to provide a game machine which can make demonstrations when a "Second Game Win" has been obtained by random selection for determining the game prize status, and which can make more effective demonstrations when a "Second Game Win" has been obtained. A game machine according to the systems and methods described herein randomly selects the game result conditions of a first game by lottery from among a plurality of conditions, and determines the game results on the basis of the randomly selected results, wherein the game machine is characterized by alerting a player by a demonstration to the fact that there is "Second Game Win" condition among the randomly selected conditions. The presentation includes various states or features, such as changes in the rotating operation of the reels, visual stimulation by special light displays, audio stimulation by special sounds, and tactile stimulation by vibrations in the operating components of the machine. Naturally, two or more states or features can be combined.

A game machine according to the systems and methods described herein includes random selection means for randomly selecting, at the beginning of the current first game, game result conditions for a predetermined prescribed number of games from among the plurality of such conditions, storage means for storing a prescribed number of game result conditions; actuating means for actuating the start of a game, determination means for determining whether or not a "Second Game Win" condition is present among the randomly selected results for a prescribed number of games, and demonstration means for displaying prescribed sensory information to the player when the "Second Game Win" condition is present. This sensory information may include visual, audio, and tactile information, either independently or in combination, similar to that described above.

A game machine optionally may include second random selection means for randomly selecting in advance several kinds of current game result conditions at the beginning of the current first game, selecting one of the several kinds of randomly selected results by a prescribed method, and actualizing the current game results, wherein a demonstration is made during the current game when the aforementioned "Second Game Win" condition is present among the several kinds of conditions randomly selected in advance. Optionally, a demonstration may be made when the randomly selected game results include at least two predetermined game results, or some combination of predetermined game results.

DETAILED DESCRIPTION OF THE PREFERRED EMBODIMENTS

In conventional types of slot machines in which the prize status is determined by random selection using random numbers for each game, when the prize status resulting from random selection in the current game is a "Big Jackpot," a demonstration is made by unusual operations, such as unusual lights or sounds, but there is no demonstration when the prize status resulting from the random selection in the current game is a "Second Game Win."

In the conventional slot machines described above, the results are randomly selected using random numbers for each game, so only the current game prize status is known. Thus, demonstrations are made only when the randomly selected result of the current game is a "Big Jackpot," and there are a fewer number of demonstrations when there are "Big Jackpots." There is thus a problem in that the demonstrations are not very effective in arousing the interest of the player to play more games.

The present invention is described below with reference to the drawings. Here, a slot machine is described as an example of a game machine according to the present invention. However, the present invention is not limited to slot machines, and may be used for any type of game machine in which game results can be randomly selected.

Figure 1:
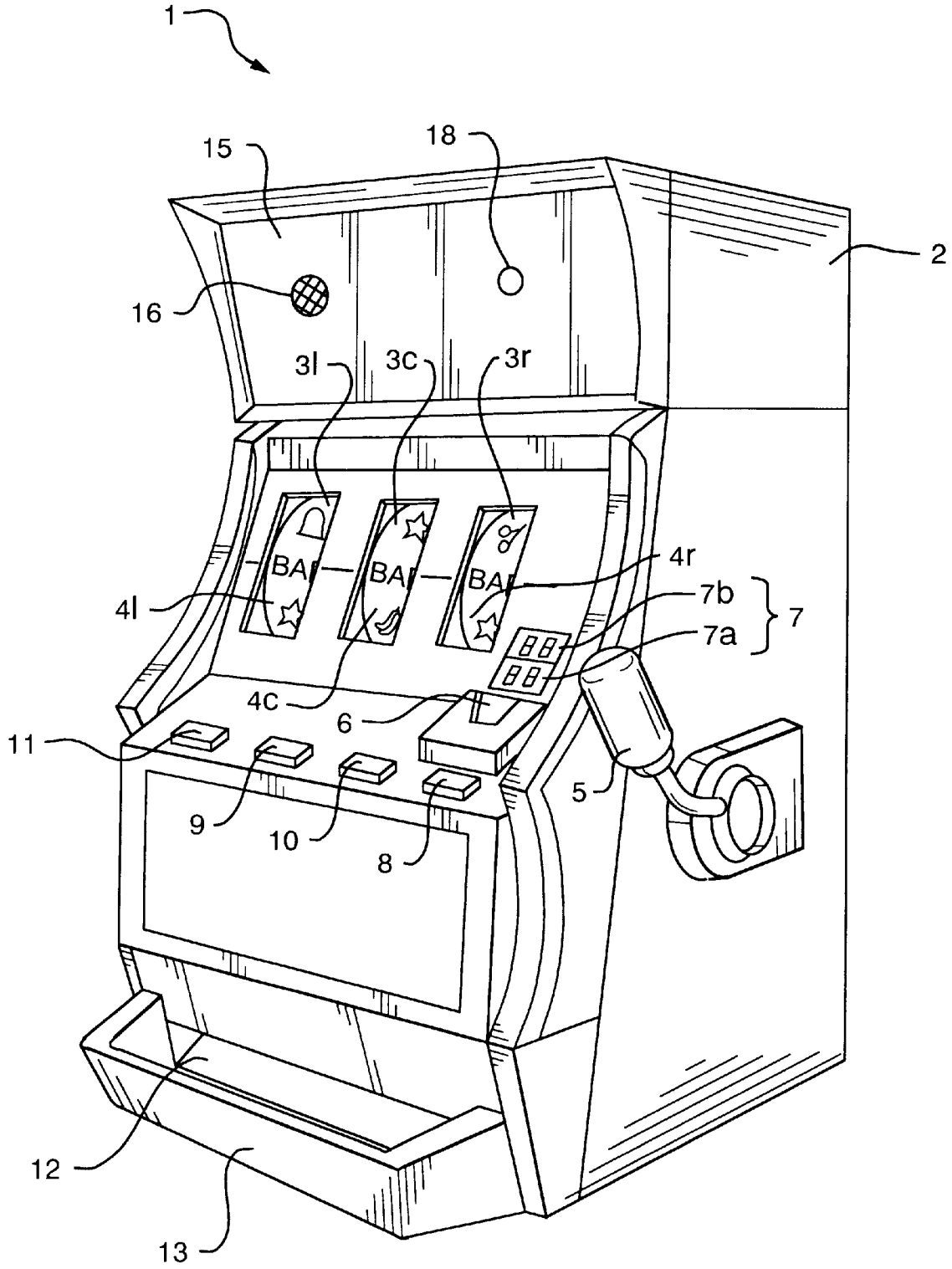
FIG. 1 illustrates the appearance of a slot machine in an embodiment of the present invention.

FIG. 1 illustrates the appearance of a slot machine in an embodiment of the present invention. The slot machine in FIG. 1 includes a main unit 1. A cabinet 2 having a front face constituting the entire main unit 1 is provided with windows 3L, 3C, 3R corresponding to a plurality of reels 4L, 4C, 4R, (three in the case of FIG. 1), for viewing the symbols on each of the reels 4L, 4C, 4R located inside the cabinet 2. A speaker 16 and one or more lights 18 is included on a display panel 15, or may be placed elsewhere on the main unit 1. Changes in the tone, volume or nature of the sounds may be broadcast through speaker 16, or changes in the color or timing of the light 18, or some combination thereof, may be used to demonstrate the prize status, i.e., the likelihood of winning a prize, to the player. Alternatively, static or moving text, numbers, or designs could be illuminated in a portion of the display panel 15 or on the main unit to indicate to the player that there is an increased likelihood of winning a "Big Jackpot". A start lever 5 for rotating the reels 4L, 4C, 4R when operated by a player is rotatably attached at a prescribed angle on a side face of the cabinet 2. A token inlet 6 for entering tokens and a digital display 7, comprising a credit number display 7A for displaying the number of tokens currently credited and a prize number display 7B for displaying the number of tokens won in the current game, are provided on the lower right side of the windows 3L, 3C, 3R on the front face of the cabinet 2.

Arranged below the windows 3L, 3C, 3R on the front face of the cabinet 2 are a spin switch 8 for setting the reels 4L, 4R, 4C in motion by the operation of a push button which is separate from the operation of the start lever 5, a single bet switch 9 for betting just one token from among the credited tokens on the game when the push button is pressed once, a maximum bet switch 10 allowing the maximum possible number of tokens to be bet on a single game when the push button is pressed once, a "C/P" switch 11 for switching between play credit/pay out of the tokens won by the player when the push button is pressed, and a token receptacle 13 for receiving tokens paid out from a token pay outlet 12 at the bottom of the front face when the "C/P" switch 11 is switched.

Figure 2:
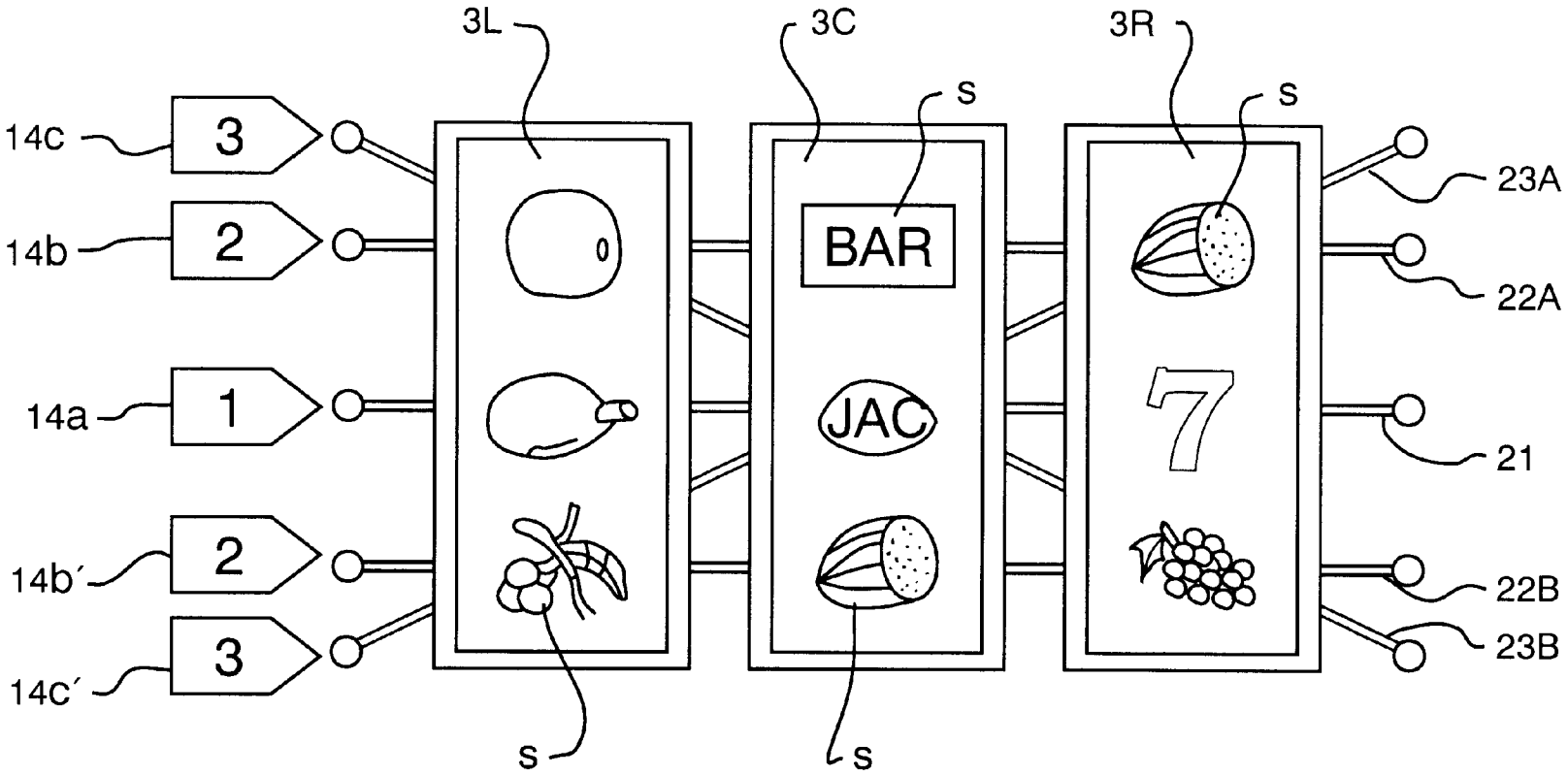
FIG. 2 is a detail of the window for viewing the reels of the slot machine depicted in FIG. 1.

FIG. 2 is a detailed view of the window for viewing the reels 4L, 4R, 4C of the slot machine depicted in FIG. 1. In this example of a slot machine, the number of prize lines can be selected according to the number of tokens entered (number of tokens bet on the game) prior to the start of the game. That is, in FIG. 2, three symbols "S" on each reel can be seen through the windows 3L, 3C, 3R. When one token is entered, only a single line 21 is activated per prize determination; when two tokens are entered, a total of three lines comprising lines 21, 22A, and 22B are activated per prize determination; and when three tokens are entered, a total of five lines comprising lines 21, 22A, 22B, 23A, and 23B are activated. In FIG. 2, a set of lamps 14*a*, 14*b*, 14*c*, 14*b'*, 14*c'*, which are marked with the characters "1", "2", and "3", lights up to display the lines that have been activated according to the number of tokens entered. The selection of the number of active lines is determined, for example, by the number of tokens entered prior to the operation of the start lever 5 or the spin switch 8.

The display lamps 14*a*, 14*b*, 14*c*, 14*b*', 14*c*' are connected so as to light up to display the lines that have been activated according to the number of tokens entered. Thus, the selection of the number of active lines is determined by the number of tokens entered prior to the operation of either the start lever 5 or the spin switch 8, or, alternatively, by the number of tokens entered after the operation of the start lever 5 and prior to the operation of the spin switch 8. When one token is entered, only one line, which is associated with one display lamp 14*a* and mark "1", is activated per prize determination; when two tokens are entered, a total of three lines, which are associated with three display lamps 14*a*, 14*b*, 14*b*' and the marks "1" and "2" are activated per prize determination; and when three tokens are entered, a total of five lines, which are associated with all five of the display lamps 14*a*, 14*b*, 14*c*, 14*b*', 14*c*' and with the marks "1", "2" and "3", are activated. This selection is done in accordance with the flowchart shown in FIG. 3.

The selection of the number of active lines may be based on a microswitch, photosensor, or other such electrical signal-based device for detection of the insertion of a token and the determination as to whether or not the start lever 5 or spin switch 8 has been operated. In the "active line" process in FIG. 3, one or more of the display lamps 14*a*, 14*b*, 14*c*, 14*b*', 14*c*' are turned on, and at the same time, a signal is input to the microcomputer described below so as to be taken into account during the determination of the prize.

Figure 3:
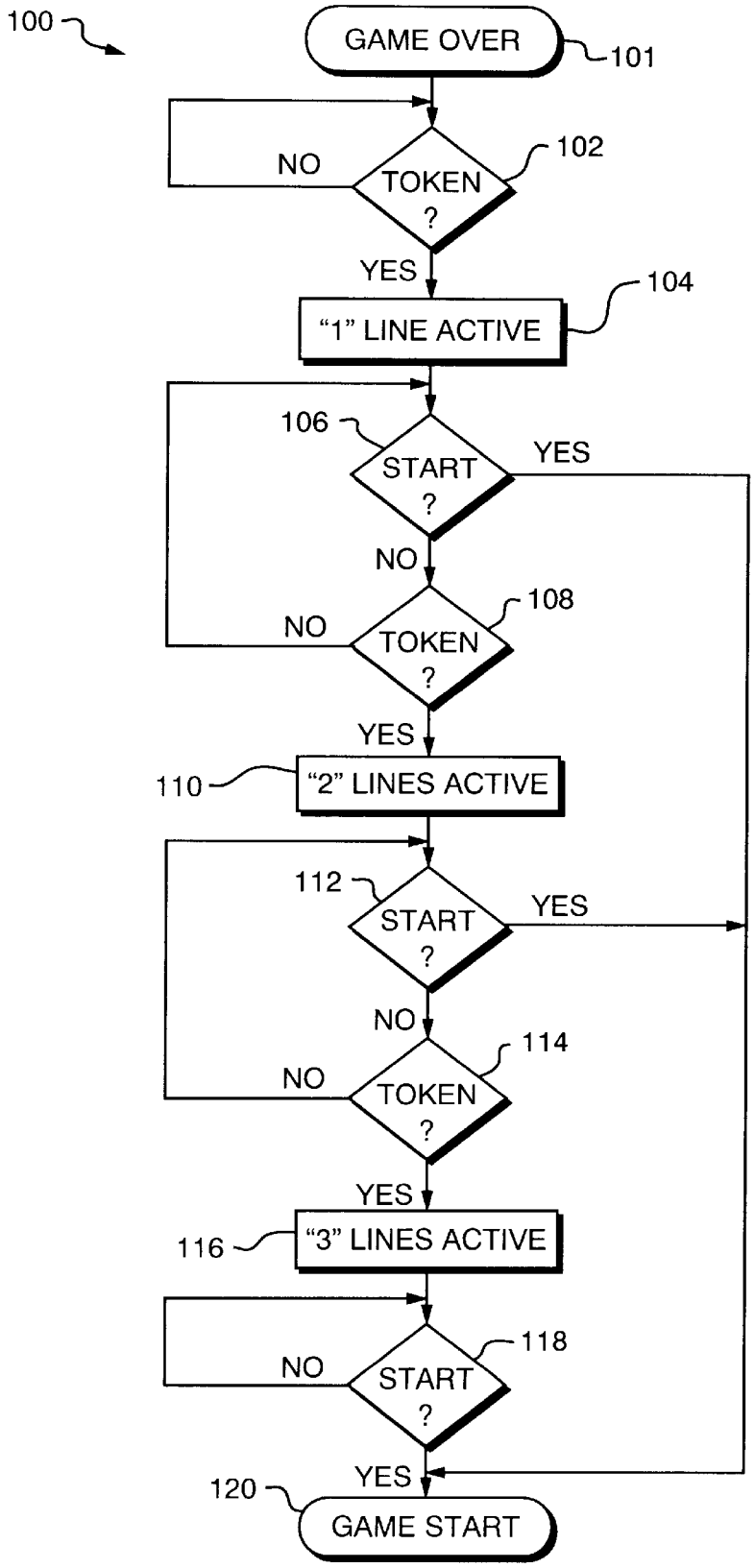
FIG. 3 is a flow chart of the process for determining active prize lines.

FIG. 3 is a flowchart 100 illustrating the selection of lines to activate by lighting up one or more of the lamps 14*a*, 14*b*, 14*c*, 14*b*', 14*c*'. The selection may be made using a microswitch, a photosensor, or another similar electrical signal-based system for detection of the insertion of a token and determination as to whether or not the start lever 5, or the spin switch 8, or both, have been operated. In the flowchart 100, the line activation process starts at a step 101 indicating conclusion of a prior game. Following the step 101 is a test step 102 that determines whether a token has been entered. The test step 102 is repeated until a token is entered. Once a token has been entered, control passes to a step 104 so that a single display lamp 14a will be lit to activate a single line, which is marked with a "1" in FIG. 1. Following the step 104 is a test step 106 that determines whether the start lever 5 has been pulled. If the start lever 5 has been pulled, then the game proceeds to a game start step 120 and the game starts. Otherwise, a test step 108 determines whether a second token has been entered. The test steps 106, 108 are repeated until either the start lever 5 is pulled or a second token is entered. If a second token is entered, control passes to a step 110 that indicates that two more lamps 14*b*, 14*b*' will be lit to activate two more lines, which are marked with a "2" in FIG. 1, for a total of three lines activated. Following the step 110, a test step 112 is performed to test whether the start lever 5 has been pulled. If the start lever 5 has been pulled, control passes from the step 112 to the game start step 120. Otherwise, a test step 114 is performed to determine whether a third token has been entered. The steps 112, 114 are repeated until either the lever 5 is pulled or a third token is entered. If a third token is entered, two more display lamps 14*c*, 14*c*', which are marked with a "3" in FIG. 1, will be lit to activate two more lines, for a total of five lines activated. A test step 118 is then performed to determine whether the start lever 5 has been pulled. If the start lever 5 has been pulled, then control passes to the game start step 120. Otherwise, the test step 118 is repeated. In the "active line" process shown in FIG. 3, one or more of the display lamps 14*a*, 14*b*, 14*c*, 14*b*', 14*c*' are turned on depending on the number of tokens entered, and, at the same time, a signal is input to the microcomputer, as described below, so that the number of token entered is taken into account during the determination of the prize.

Figure 4:
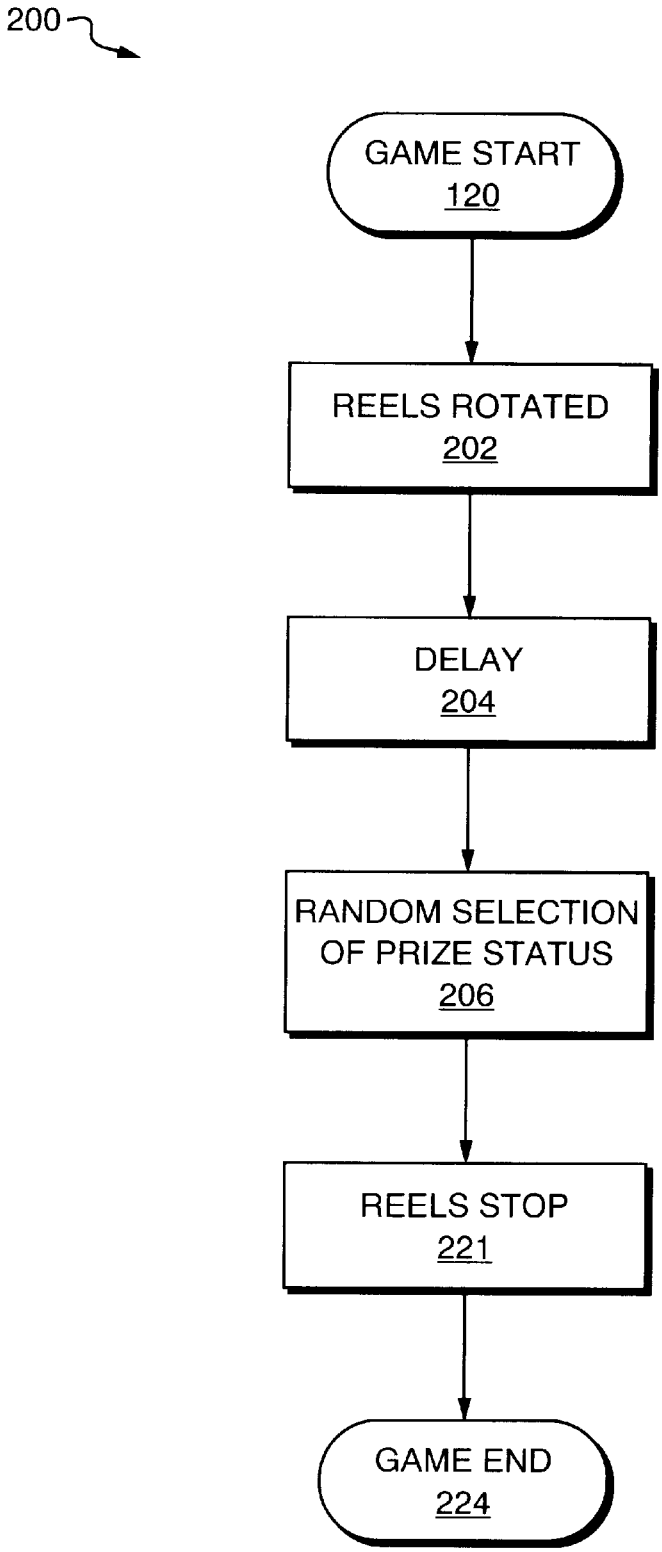
FIG. 4 is a flow chart of the basic game progress of a slot machine according to the present invention.

After the number of prize lines has thus been determined, the game basically progresses according to the flow chart in FIG. 4. That is, the game starts when the start lever 5 or spin switch 8 is operated, the three reels rotate, the prize status described below is randomly selected after a prescribed period of time has passed, the reels automatically stop based on the randomly selected results, and the current game is terminated.

FIG. 4 is a flowchart 200 illustrating progress of the game once the number of prize lines has been determined in accordance with the process shown in FIG. 3 (or by following one of a variety of conventional processes equivalent to that shown in FIG. 3). The game begins at the game start step 120 (of FIG. 3). A reel rotation step 202 follows the start step 120. Following the reel rotation step 202 is a delay step 204. Following the delay step 204 is a result selection step 206 in which the results for a plurality of games are randomly selected to provide a random selection of prize status. Following the result selection step 206 is a reels stop step 221 in which the reels are stopped, optionally in response to a player's pressing of stop buttons. After the step 221, control passes to a game end step 224.

Figure 5:
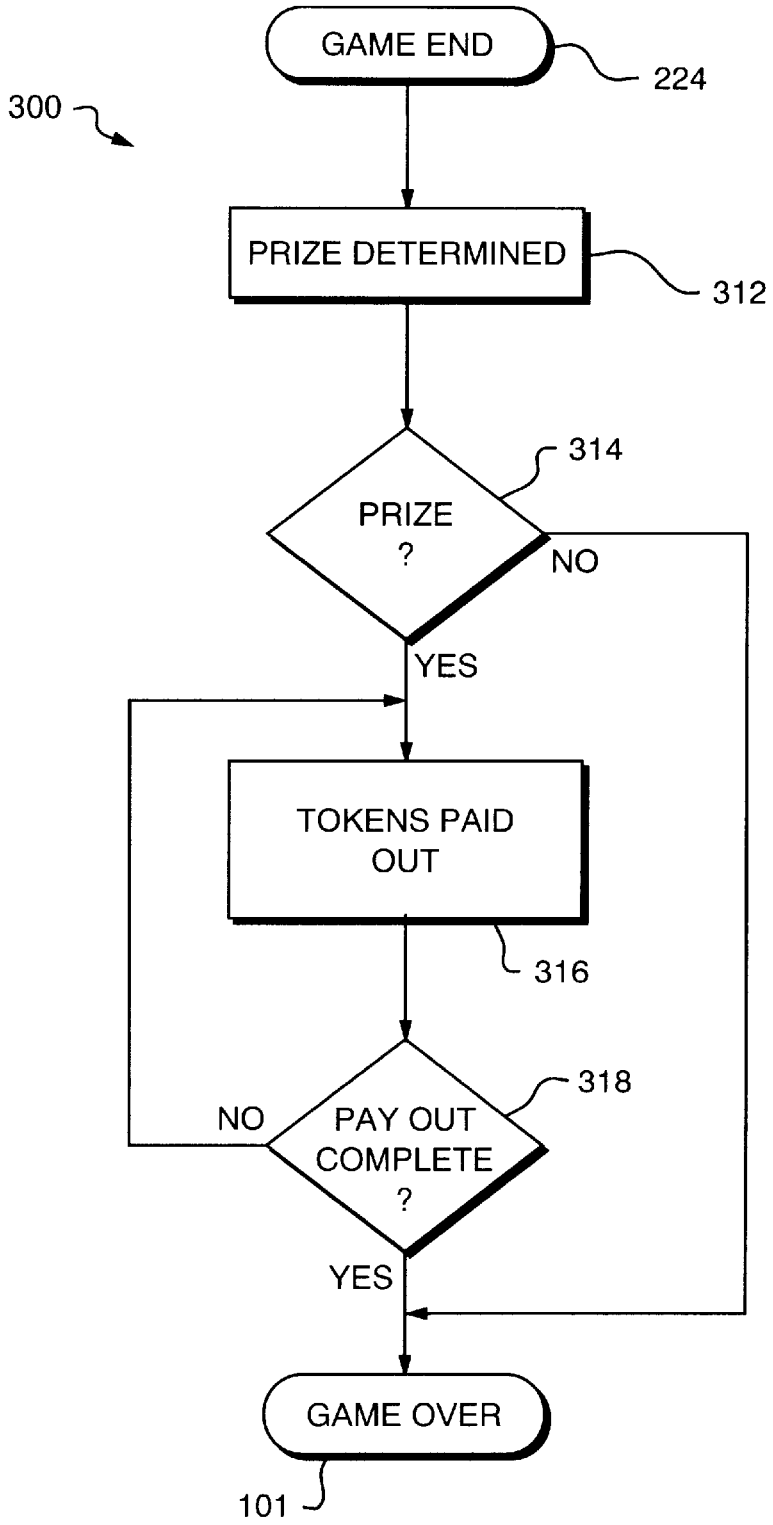
FIG. 5 is a flow chart of the process from the determination of the prize to the pay out of tokens.

When the game is over, the process for determining the prize is carried out according to the flow chart in FIG. 5, for example, and tokens are paid out when a prize has been won. During the determination of a prize, photoelectric signal components provided for the symbols on the reels are read by photosensors, for example, or signal components may be provided at locations on the reels so that reset pulses are obtained for each reel rotation by pulse motors that drive the reels, allowing it to be determined whether a pulse signal has been supplied for any pulse to the pulse motor until the reels are stopped following the production of the reset pulse.

FIG. 5 is a flowchart 300 illustrating the determination of the prize when the game is over. Following the game end step 224 (of FIG. 4), control passes to a step 312 in which determination of the prize is made. Following the step 312 is a test step 314 which tests whether a prize was won. If so, control passes to a step 316. Otherwise, control passes to the game over step 101 (of FIG. 3). In the step 316, the prize tokens are paid out in the proper amount. Following the step 316 is a test step 318 in which it is determined whether the paying out has been completed. If so, control passes to the game over step 101. Otherwise, control returns to the step 316 and the process is repeated until the game over step 101 is reached.

Figure 6:
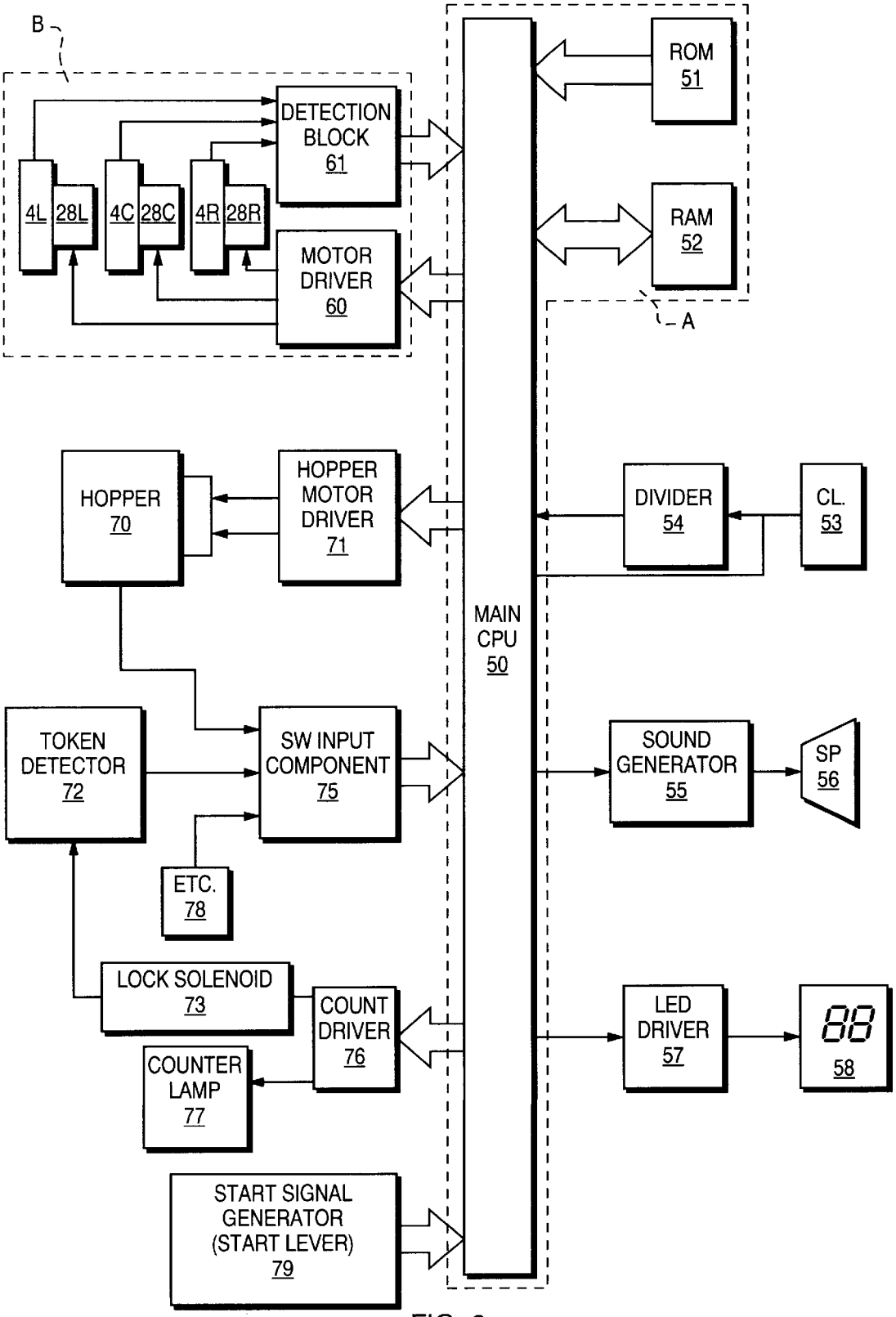
FIG. 6 is a block diagram depicting a microcomputer controlling a slot machine according to the present invention.

FIG. 6 is a block diagram depicting the microcomputer controlling the slot machine in the present embodiment. In FIG. 6, the broken line block A is a main control component having a main CPU 50, a ROM 51, and a RAM 52. The ROM 51 stores a correspondence table of the symbols described above and symbol codes, a table of symbol codes corresponding to prizes and the number of prize tokens paid out, as well as prize probability tables and the like according to prize status when a prize is awarded for the game that has been run. The RAM 52 prepares random number stores for temporarily storing random numbers sampled after the start of a game, memory for temporarily storing data such as rotating reel code numbers and symbols, and the like.

A clock pulse generator 53 generates, for example, a four MHZ pulse, and that actuates the main CPU 50 based on this standard pulse, and a divider 54 gives an interruption pulse of 500 Hz, for example, to the main CPU 50 for the interrupt execution process of a prescribed program. A sound generator 55 is driven so as to produce sounds by means of a speaker 56 in order to enhance game interest at prescribed periods after the start of the game. The speaker 56 can be used as the demonstration means described below. An LED drive component 57 drives a 7-segment digital display light-emitting diode 58, for example. This diode 58 can be used to display the number of tokens paid out or the like.

The broken line block B in FIG. 6 is a reel drive view block. In this embodiment, reels 4L, 4C, 4R are driven by pulse motors 28L, 28C, 28R. The motors 28L, 28C, 28R are rotated by drive pulses from a motor drive component 60. For example, the reels are rotated one reel symbol at a time, as seen through windows 3L, 3C, 3R, per pulse. The reels are constructed in such a way that a reset signal is produced per rotation. The reset signals are detected by a detection block 61. In the main CPU 50, the reset signals are detected by the detection block 61, and the number of drive pulses given to the motor is then counted, allowing the reel symbols visible in the windows 3L, 3C, 3R to be specified.

In the prize determination, the symbols of the reels are used as code signals as described above, and the combination is matched with the ROM described below. A prize token pay out hopper 70 and a hopper motor drive component 71 also are shown. A token detector 72 detects the insertion of tokens prior to the start of the game. When a prize has been won, the hopper motor for paying out prize tokens is driven to pay out the prize tokens. The tokens that are paid out are counted, for example, by the token counter 72 located in the token pay out chute, and the game is over when the prescribed number of tokens has been reached. The signal for the number of tokens paid out from the hopper 70 and the signal for the number of tokens entered from the token detector 72 are sent via a "Sw" input component 75 and main CPU 50 from a count drive component 76 to a counter or lamp 77, the number of tokens entered or paid out is detected, or one or more of the display lamps 14*a*, 14*b*, 14*c*, 14*b*', 14*c*' for the active prize lines are lit up according to the number of tokens entered. The display lamps 14*a*, 14*b*, 14*c*, 14*b*', 14*c*' can also be used as the demonstration means described below. When three tokens are entered, a lock solenoid 73 that locks the entered tokens is driven. Another switch operating component 78, such as a stop switch or the like, is operated when a player wishes to stop a game after a token has been entered. A start signal generator 79 is constructed, for example, of the aforementioned start lever 5 or spin switch 8.

The system structure described above allows the determination process for the basic progress of the game shown in the flow charts above to be carried out by the prescribed executing program using the main CPU 50.

The method for randomly selecting the prize status and the method for determining whether or not a demonstration is to be put on, which are features of this embodiment, are described below. The prize status is randomly selected as a result of a match between the random number values sampled at the start of the game, as described above, and the groups of numerical values for awarding a prize which are stored in the prize table in the ROM.

Figure 7A:
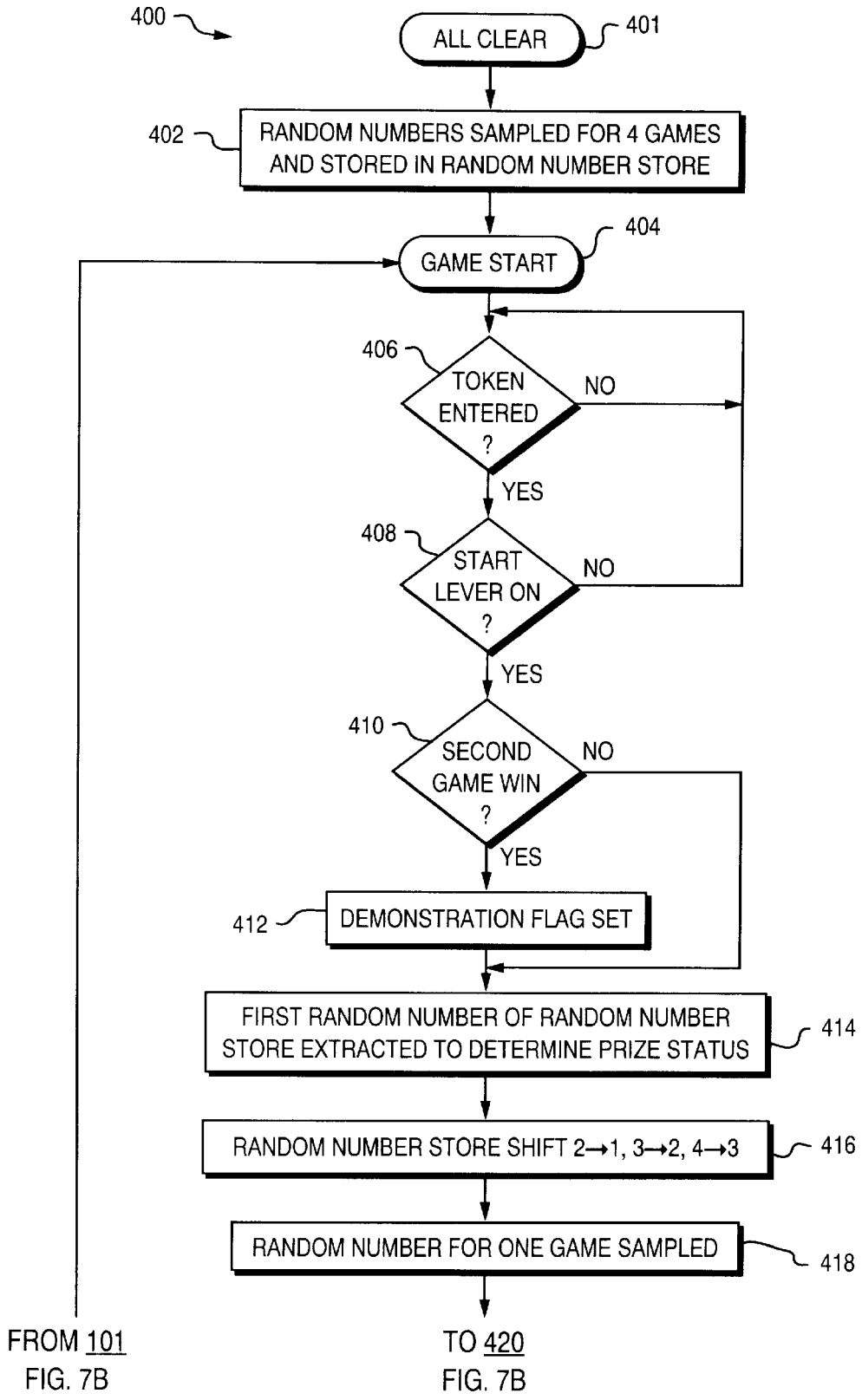
FIG. 7 is a flow chart describing the operation of a slot machine in an embodiment of the present invention.
Figure 7B:
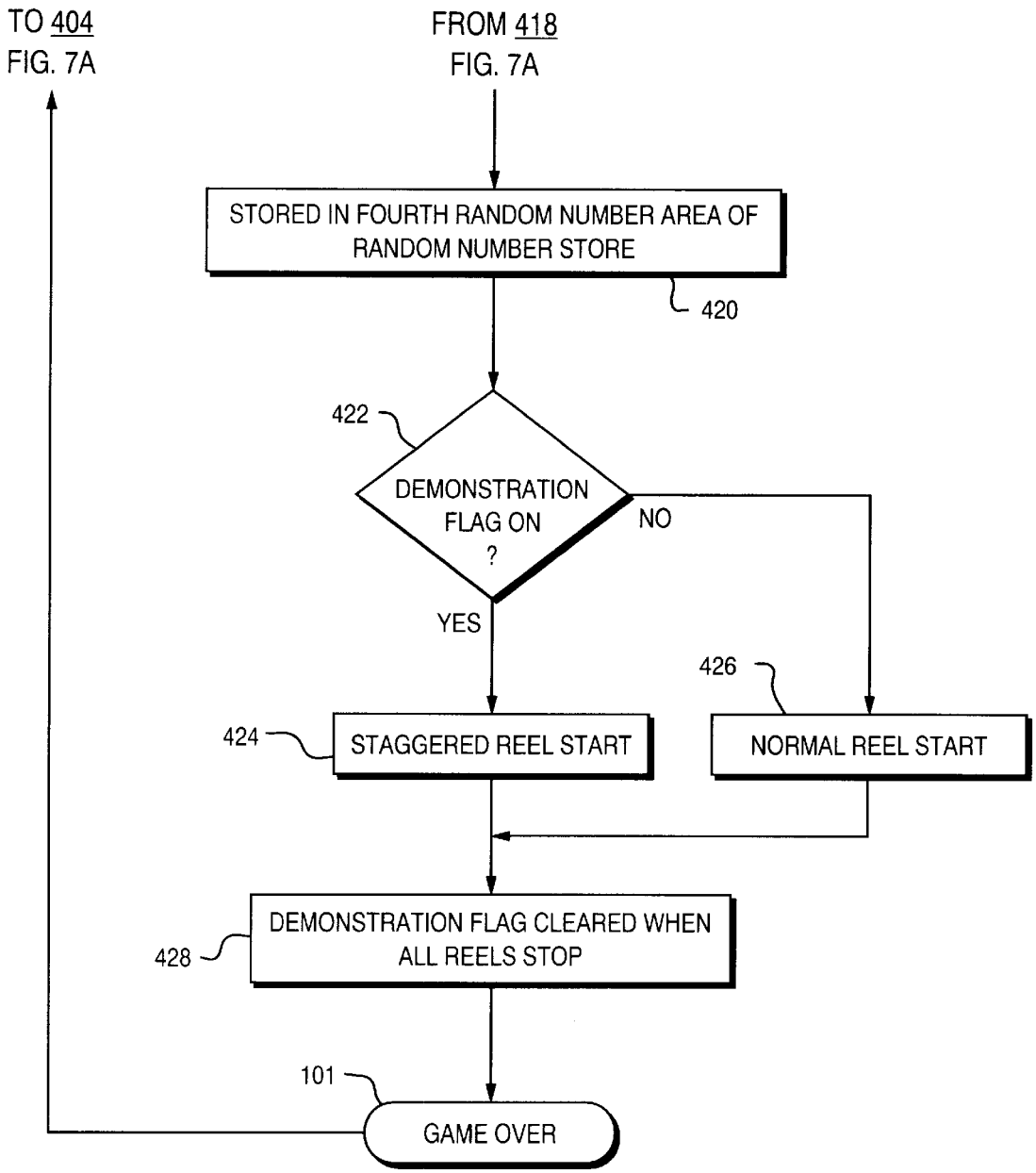
Figure 8:
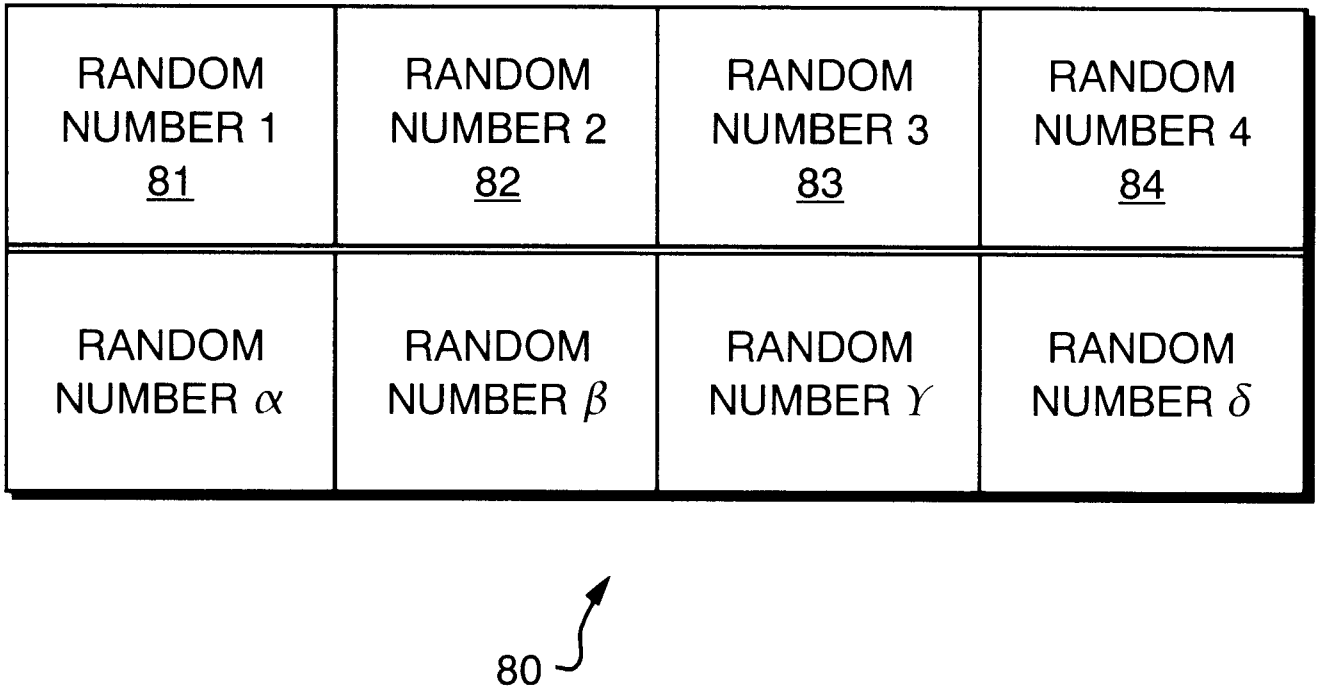
FIG. 8 is an illustration of the structure of the random number store in an embodiment of the present invention.

FIG. 7 is a flow chart describing the operation of the slot machine in the present embodiment. FIG. 8 is an illustration of the structure of the random number store in the present embodiment.

FIG. 7 is a flowchart 400 describing one possible method of operation of the slot machine in an embodiment of the present invention and FIG. 8 is an illustration of the structure. Turning first to FIG. 7, the operation process begins at an all clear step 401. Following the step 401 is a step 402 in which random numbers are sampled for four games and stored in a random number store (shown in FIG. 8 and described below). Following the step 402 is a game start step 404 in which the game starts. Following the step 404 is a test step 406 in which a test is made to determine whether a token has been entered. If so, control passes to a test step 408. Otherwise, the test step 406 is repeated. In the test step 408, it is determined whether the start lever 26 is on. If so, control passes to a test step 410. The test steps 406, 408 are repeated until either the start lever 26 is on or a token is entered. In the test step 410, a determination is made whether there is a "Second Game Win" result. If so, control passes to a step 412 in which a demonstration flag is set, and, following the step 412, control passes to a step 414. Otherwise, control passes from the step 410 to the step 414 and thus the demonstration flag is not set. In the step 414, a first random number is extracted from the random number store to determine the prize status. Following the step 414 is a step 416 in which the random numbers in the random number store are shifted, as described below. Following the step 416 is a step 418 in which a random number for one game is sampled. Following the step 418 is a step 420 in which the random number sampled in the step 418 is stored in the fourth random storage number area of the random number store. Following the step 420 is a test step 422 in which it is determined whether the demonstration flag is ON. If so, control passes to a step 424 in which reel rotation starts in a staggered manner. Otherwise, control passes to a step 426 in which reel rotation starts in a normal manner. Following each of the steps 424, 426 is a step 428, in which the demonstration flag is cleared when all reels stop rotating. Following the step 428, control passes to the game over step 101.

When, for example, the main power source switch of the slot machine is turned on, or when a clear switch not shown in the figures is switched ON, the entire system is initialized, the random numbers stored in a random number store 80 shown in FIG. 8 are cleared, and the demonstration flag is cleared.

As shown in FIG. 8, the random number store 80 has four random number areas: a first random number area 81, a second random number area 82, a third random number area 83, and a fourth random number area 84, in which the four random numbers comprising random number $\alpha$, random number $\beta$, random number $\gamma$, and random number $\delta$ can be stored. The random number stored in the first random number area 81 is used in the random selection of the current game prize status, the random number stored in the second random number area 82 is used in the random selection of the prize status in the game following the current game, the random number stored in the third random number area 83 is used in the random selection of the prize status of the subsequent game, and the random number stored in the fourth random number area 84 is used in the random selection of the prize status in the game after that. That is, random numbers to be used up through the next three games from the current game are stored.

To return to the flowchart 400 of FIG. 7, in the all clear step 401, the entire system is initialized and the random numbers stored in the random number store 80 are cleared. Following the all clear step 401 is the step 402 in which random numbers for four games (a total of four random numbers) are sampled and the sampled random numbers are stored in the first, second, third and fourth areas 81–84 in the random number store 80. Following the step 402 is the game start step 404, where the main unit 10 of the slot machine is placed in game start mode. In the step 406, it is determined whether a token has been inserted. In the step 408, which occurs after a token has been inserted, it is determined whether the start lever 5 or the spin switch 8 has been pulled.

When the start lever 5 has been actuated, it is determined at the test step 410 whether any of the four random numbers in the random number store 80 correspond to a "Second Game Win" condition. When there is no "Second Game Win" condition, the game proceeds to the step 414. When there is a "Second Game Win" condition, a demonstration flag is set up in the step 412. Alternatively, a different type of demonstration could be made depending on whether a different combination of game results, including, for example, a "Big Jackpot" and a "Second Game Win", or a "Small Jackpot" and a "Second Game Win", or a "Second Game Win" and a "One Shy" condition (which will be described below), or some variation thereof, was present in one or more of the areas in the random number store 80. For example, a state in which there is no "Big Jackpot" because the symbol on one of the reels 4L, 4C, 4R (three reels in the present embodiment) does not match (here, the state of two matches is called "One Shy"). (If four or more reels were used and all but two reels matched, then the state could be called "Two Shy", and so on, depending on the number of reels used. For example, the condition of having all but a predetermined number of reels, or dice, or other similar type of game feature, match or correspond is referred to herein as a pseudo specific game result condition.) Alternatively, a different type of demonstration could be made depending on whether a "One Shy", "Two Shy", "Big Jackpot", "Little Jackpot", "Second Game Win," multiple "Free" or "Bonus" games, or some combination or variation thereof, was present in one or more of the areas in the random number store 80.

In the step 414, a random number is taken from the first random number area 81 in the random number store 80. The random number thus taken is used for random selection of the current game prize status, and the current game prize status is determined. In the step 416, the random number stored in the second random number area 82 is then moved to the first random number area 81, the random number stored in the third random number area 83 is moved to the second random number area 82, and the random number stored in the fourth random number area 84 is moved to the third random number area 83. In the step 418, a new random number to be stored in the fourth random number area 84 is then sampled. In the step 420, the new random number is stored in the fourth random number area 84.

In the step 422, the system checks to see whether or not the demonstration flag is ON, i.e., is set. When the demonstration flag is not ON, the reels begin to rotate together as usual in the step 426. When the demonstration flag is ON, the reels start rotating in a staggered manner (for example, the first reel 4L is rotated, and a little while later the second and third reels 4C, 4R are rotated) in the step 424. A demonstration may be made shortly after the reels begin to rotate. That is, a player may know there is no probability of a "Big Jackpot" or a "Second Game Win" when the reels start to rotate simultaneously, whereas a player may know that there is a probability of a "Big Jackpot" or a "Second Game Win" when the reels start rotating in a staggered manner, thereby giving the player greater hope. When all the reels are stopped, the demonstration flag is cleared in a clearing step 428, and the game is over. The system subsequently returns to the game start step 404 at the start of the game, and the next game is begun.

In the present embodiment, it is possible to determine the prize status, that is, the stopping position of all of the reels 4L, 4C, 4R with one random number. However, the present invention is not limited to this embodiment, and a random number may be provided for each reel.

To return to the description in FIG. 7, random numbers for four games (total of four random numbers) are sampled in the step 402, the sampled random numbers are stored in the four random numbers areas 81–84 in the random number store 80, and the slot machine is put in game start mode 404. Whether or not a token has been inserted is then detected in the step 406, and after a token has been inserted, whether or not the start lever 5 or the spin switch 8 has been pulled on is then detected in the step 408.

When the start lever 5 is on, the step 410 checks to see whether or not any of the four random numbers in the random number store 80 correspond to a "Second Game Win" state, that is, a prize allowing a second subsidiary game to be played. When there is no "Second Game Win" random number, the game proceeds to the step 414, and when there is a "Second Game Win" random number, a demonstration flag is set up in the step 412.

In the step 414, a random number is taken from the first random number area 81 in the random number store 80, the random number thus taken is used for the random selection of the current game prize status, and the current game prize status is determined. The random number stored in the second random number area 82 of the random number store 80 is then moved to the first random number area 81, the random number stored in the third random number area 83 is moved to the second random number area 82, and the random number stored in the fourth random number area 84 is moved to the third random number area 83 in the step 416. A new random number to be stored in the fourth random number area 84 of the random number store 80 is then sampled in the step 418, and the new random number is then stored in the fourth random number area 84 in the step 420.

Here, the system checks to see whether or not the demonstration flag is ON, namely, is set in the step 422. When the demonstration flag is not ON, the reels begin to rotate together as usual in the step 426, and when the demonstration flag is ON, the reels start rotating while staggered (for example, reel 4L is rotated, and a little while later reels 4C and 4R are rotated) in the step 424. In the present embodiment, a demonstration is made a little after the reels begin to rotate. That is, the player knows there is no probability of a "Second Game Win" when the reels start to rotate simultaneously, whereas the knowledge that there is a probability of a "Second Game Win" when the reels start rotating while staggered gives the player greater hope. When all the reels are stopped, the demonstration flag is cleared in the step 428, and a second game is played if there is a "Second Game Win," and the game is over when the second game is over. The system subsequently returns to the step 404, and the next game is begun. When there is no "Second Game Win" in the step 410, the demonstration flag is not set and the system subsequently returns to the step 404 without playing a second game, and the next game is played. Thus, a player must enter one or more tokens to play the next game if there is no "Second Game Win" in the step 410. However, if there is a "Second Game Win", the game machine will recognize that fact and the player will not be required to enter more tokens to play another game after the system reaches the step 101 at the end of the first game. Thus, with reference to FIG. 3, when a "Second Game Win" result has been achieved, the game will proceed directly to step 104 without requiring a positive response in the test step 102 in which the system normally checks to see if a token has been entered before activating the first line. Optionally, a player could be required to enter additional tokens to activate additional lines in the "Free" or "Bonus" second game, or more than one line could be activated automatically, without the insertion of additional tokens, as part of the prize from the first game.

In the present embodiment, random numbers for the current game through the next three games are previously sampled and are used to determine whether or not a demonstration is to be made in the current game, so there is a greater number of games with demonstrations, making it possible to provide effective demonstrations arousing the interest of the player.

In the present embodiment, a demonstration is made on the possibility of a "Second Game Win" at the beginning of the first game, but the present invention is not limited to this. The results of the second game may be randomly selected at the first game stage, with a presentation made according to the results of the second game.

In the present embodiment, a plurality of random numbers to be used in the next three games can be stored in the random number store 80, but the present invention is not limited to this, and a plurality of random numbers to be used in more or less than the next three games can also be stored in the random number store 80.

Another alternative embodiment of a slot machine applying the present invention is described below. The appearance and basic operation of the slot machine in this alternative embodiment are similar to those of the embodiment described above, so FIGS. 1 through 6 are also applicable here and will not be described again.

The method for randomly selecting the prize status and the method for determining whether or not a demonstration is to be made, which are features of the alternative embodiment, are described first. As described above, the prize status is randomly selected as result of a match between the random number values sampled at the start of the game and the groups of numerical values for awarding a prize which are stored in the prize table in the ROM 51.

Figure 9A:
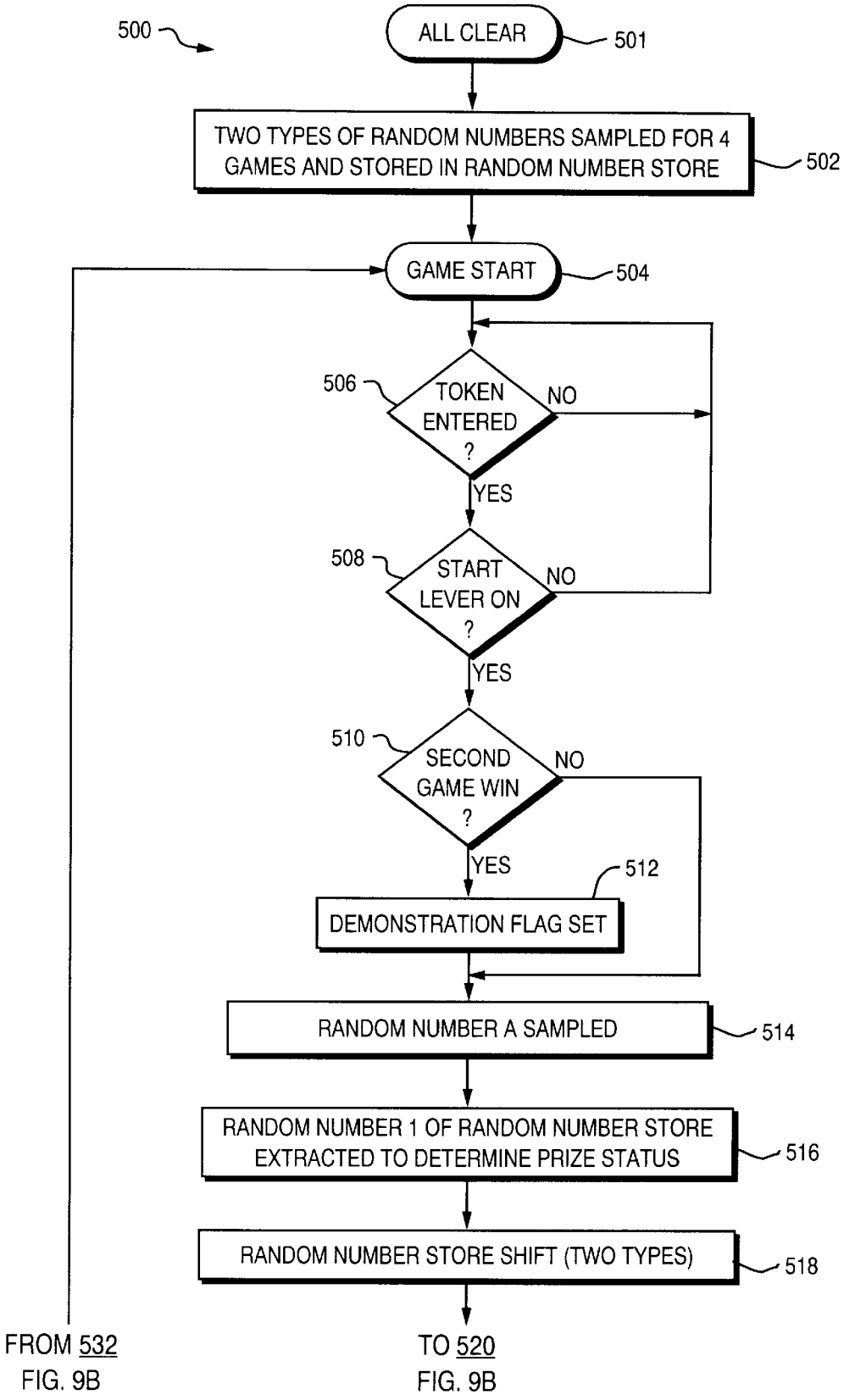
FIG. 9 is a flow chart of the operation of the slot machine in another embodiment of the present invention.
Figure 9B:
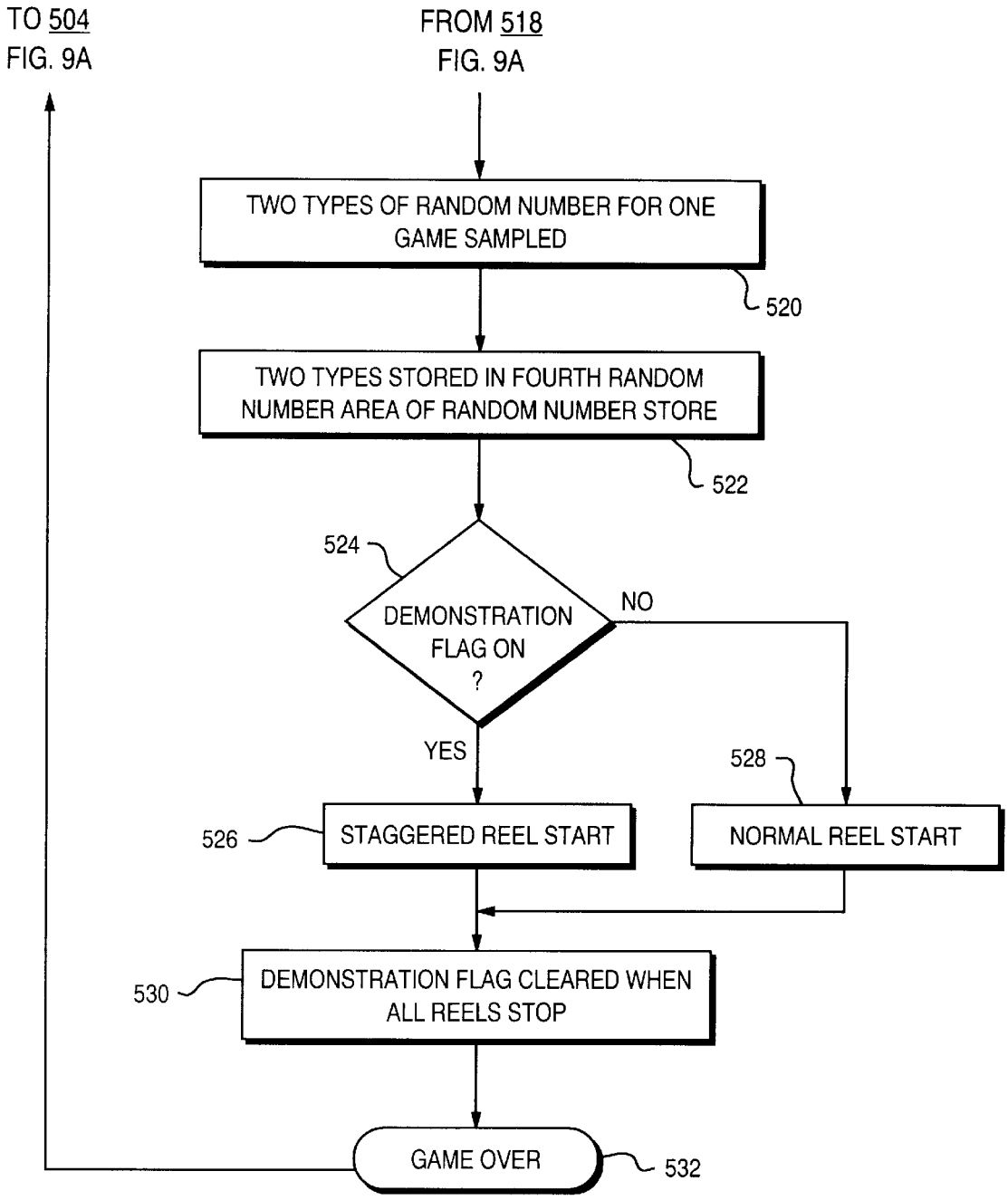
Figure 10:
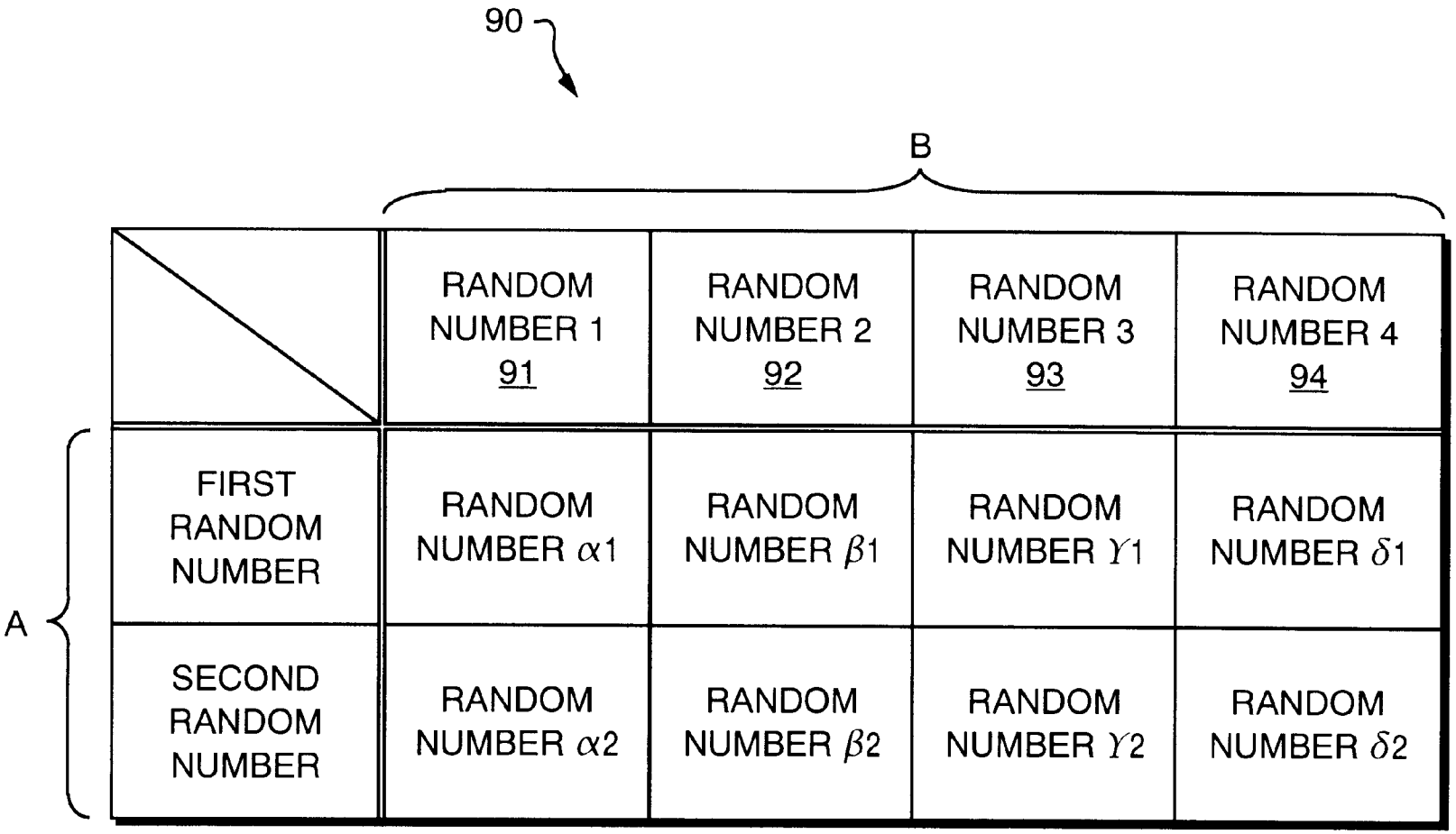
FIG. 10 illustrates the structure of the random number store in another embodiment of the present invention.

FIG. 9 is a flow chart of the operations of the slot machine in the present embodiment. FIG. 10 illustrates the structure of the random number store in the present embodiment.

FIG. 9 is a flowchart 500 illustrating operation of the slot machine in the additional alternative embodiment. The process begins with an all clear step 501. Following the step 501 is a step 502 in which two types of random numbers are sampled for four games and are stored in the random number store. Following the step 502 is a game start step 504 in which the game is started. Following the step 504 is a test step 506 in which it is determined whether a token has been entered. If so, control passes to a test step 508. Otherwise, the test step 506 is repeated until a token is entered.

In the test step 508, it is determined whether the start lever is ON. If so, control passes to a test step 510. Otherwise, the test steps 506, 508 are repeated until either a token is entered or the start lever 26 is ON. In the test step 510, it is determined whether a "Second Game Win" condition occurs in the random number store. If so, control passes to a step 512 in which a demonstration flag is set. Otherwise, control passes from the step 510 to a step 514. In the step 514, a random number from a category A (described below) is sampled. Following the step 514 is a step 516 in which a random number from the first random number area of the random number store is extracted to determine the prize status for the current game. Following the step 516 is a step 518 in which there is a shift of the numbers in the random number store (as described below). Following the step 518 is a step 520 in which two types of random numbers are sampled for one game. Following the step 520 is a step 522 in which the two types of random numbers sampled in the step 520 are stored in the fourth random number storage area in the random number store. Following the step 522 is a test step 524 in which it is determined whether the demonstration flag is ON. If so, control passes to a step 526 in which a staggered reel start is made. Otherwise, control passes from the step 524 to a step 528 in which a normal reel start is made. Following the step 526 or the step 528 is a step 530. In the step 530, the demonstration flag is cleared when all reels stop. Following the step 530 is a game over step 532. Following the game over step 532, control returns to the game start step 504.

When, for example, the main power source switch of the slot machine is turned on, or when a clear switch not shown in the figures is switched ON, the entire system is initialized, the random numbers stored in the random number store 90 shown in FIG. 10 are cleared, and the demonstration flag described below is cleared in the step 501.

As shown in FIG. 10, the random number store 90 has four areas: a first random number area 91, a second random number area 92, a third random number area 93, and a fourth random number area 94, in each of which are provided two types of areas for first and second random numbers. The random number store 91 can thus store eight random numbers consisting of random numbers $\alpha 1$ and $\alpha 2$, random numbers $\beta 1$ and $\beta 2$, random numbers $\gamma 1$ and $\gamma 2$, and random numbers $\delta 1$ and $\delta 2$. Here, the random numbers stored in the random number store 90 are referred to as random numbers B.

Either of the two types of random numbers (first and second random numbers) stored in the first random number area 91 is used in the random selection of the current game prize status, either of the two random numbers stored in the second random number area 92 is used in the random selection of the prize status in the game following the current game, either of the numbers stored in the third random number area 93 is used in the random selection of the prize status of the subsequent game, and either of the random numbers stored in the fourth random number area 94 is used in the random selection of the prize status in the game after that. That is, random numbers to be used up through the next three games from the current game are stored.

In this embodiment, separate random numbers that are not stored in the random number store 90 are also provided. These random numbers are referred to as random numbers A. The random numbers A are random numbers obtained by the random generation of two types of numbers such as 0 and 1. The random number used in the current game is selected from between the two random numbers (first and second random numbers) stored in random number 1 of the random store 90, depending on whether the random number A is 0 or 1.

In the present embodiment, the prize status, that is, the position where the reels 4L, 4C, 4R stop, can be determined with one random number. The present invention is not limited to this, however, and random numbers may be provided for each reel.

To return to the description in FIG. 9, in the step 502, random numbers for four games (total of eight random numbers) are sampled, the sampled random numbers are stored in the four random number areas 91–94 in the random number store 90, and the slot machine is put in game start mode in the step 504. Whether or not a token has been inserted is then detected in the step 506, and after a token has been inserted, whether or not the start lever 5 or spin switch 8 has been pulled on is then detected in the step 508.

When the start lever 5 or spin switch 8 is on, the step 510 checks to see whether or not any of the eight random numbers in the random number store 90 correspond to a "Second Game Win" state, that is, a prize allowing a second subsidiary game to be played. When there is no "Second Game Win" random number, the game advances to the step 514, and when there is a "Second Game Win" random number, a demonstration flag is set in the step 512.

In the step 514, the random numbers A described above are sampled, and the random number used in the current game is determined from among the two types of random numbers (random numbers ($\alpha 1$ and $\alpha 2$) stored in the first random number area 91 of the random number store 90 based on the value of the random number A. The random number thus determined is taken from the random number store 90 and is used for the random selection of the prize status of the current game to determine the prize status of the current game in the step 516. The two types of random numbers scored in the second random number area 92 of the random number store 90 are then moved to the first random number area 91, the two types of random numbers stored in the third random number area 93 are moved to the second random number area 92, and the two types of random numbers stored in the fourth random number area 94 are moved to the third random number area 93, in the step 518. Two new random numbers to be stored in the fourth random number area 94 of the random number store 90 are then sampled in the step 520 and stored in the fourth random number area 94 in the step 522.

Here, the system checks to see whether or not the demonstration flag is ON, namely, is set in the step 524. When the demonstration flag is not ON, the reels begin to rotate together as usual in the step 528, and when the demonstration flag is ON, the reels start rotating while staggered (for example, reel 4L is rotated, and a little while later reels 4C and 4R are rotated) in the step 526. In the present embodiment, a demonstration is made a little after the reels begin to rotate. That is, the player knows there is no probability of a "Second Game Win" when the reels start to rotate simultaneously, whereas the knowledge that there is a probability of a "Second Game Win" when the reels start rotating while staggered gives the player greater hope. However, whether or not the random number for the "Second Game Win" is actually used is randomly selected after the demonstration flag has been set, so the result sometimes ends up a "loss" despite the demonstration, contradicting the expectations of the player and arousing his or her ire. Thus, when all the reels have stopped, the demonstration flag is cleared in the step 530, a second game is played when there is a "Second Game Win," and the game is over upon the conclusion of the second game. The system subsequently returns to the step 504, and the next game is begun. When there is no "Second Game Win" in the step 510, the game is over, and the system then returns to the step 504 for the next game.

In the present embodiment, random numbers for the current game through the next three games are previously sampled and are used to determine whether or not a demonstration is to be made in the current game, so there is a greater number of games with demonstrations, making it possible to provide effective demonstrations arousing the interest of the player.

In the present embodiment, random numbers used in the current game are selected from two types of numbers (first and second random numbers), so a total of eight random numbers are used as a basis for determining whether or not a demonstration is to be made, thus increasing the number of games with demonstrations and making it possible to provide effective demonstrations arousing the interest of the player.

In the present embodiment, a demonstration is made on the possibility of a "Second Game Win" at the beginning of the first game, but the present invention is not limited to this. The results of the second game may be randomly selected at the first game stage, with a presentation made according to the results of the second game.

In the present embodiment, a plurality of random numbers to be used in the next three games can be stored in the random number store 90, but the present invention is not limited to this, and a plurality of random numbers to be used in the next several games can also be stored in the random number store 90.

In the present embodiment, random numbers A allowing two types of random numbers to be taken are provided, and two different types of random numbers used per game are stored in the random number store 90, but the present invention is not limited to this; random numbers A allowing several random numbers to be taken may be provided, and the random numbers used per game may be stored in groups of several in the random number store 90.

The demonstration means in the present embodiments involved staggering the reels, but the invention is not limited to this and may also be constructed so as to appeal to the overall senses of the player by flashing the display lamps of the prize line or the sound from a sound generator.

The embodiments described above were related to mechanical types of slot machines in which reels are rotated but the present invention is not limited to this mechanical type of slot machine and can also be applied to video game machines. The present invention is not limited to slot machines and can be applied to poker game machines or any other type of game machine allowing the game results to be randomly selected. When the present invention is applied to video game machines, the display image can be warped, for example, as a demonstration.

As described above, the game machine described herein arouses the interest of the play to play more games because demonstrations are made when a "Second Game Win" has been obtained by random selection to determine the game prize status.

In another embodiment, the game machine described herein randomly selects game results from the current game to the next several games, and determines whether or not a demonstration is to be made in the current game, so there are more games with presentations, allowing effective demonstrations to be made to arouse the interest of the player in playing more games.

In an alternative embodiment, the game machine described herein selects the game result state to be used in the current game from among various types states, so there are more games with presentations, allowing effective demonstrations to be made to arouse the interest of the player in playing more games.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. A game machine that randomly selects a plurality of game result conditions corresponding to a plurality of different games including a current game and at least one subsequent game, and that determines a game result for the current game on the basis of one of the plurality of game result conditions for the plurality of different games, the game machine including an alert to a player when there is a "Second Game Win" condition among the plurality of game result conditions indicating a free game.

2. A game machine according to claim 1, further comprising:

random selection means for randomly selecting, at the beginning of the current first game, game result conditions for a predetermined prescribed number of games from among the plurality of such conditions, storage means for storing a prescribed number of game result conditions;

actuating means for actuating the start of a game;

determination means for determining whether or not a "Second Game Win" condition is present among the randomly selected results for a prescribed number of games; and demonstration means for displaying prescribed sensory information to the player when the "Second Game Win" condition is present.

3. A game machine according to claim 1, further comprising:

second random selection means for randomly selecting in advance several kinds of current game result conditions at the beginning of the current first game;

selecting one of the several kinds of randomly selected results by a prescribed method; and actualizing the current game results, wherein a demonstration is made during the current game when the aforementioned "Second Game Win" condition is present among the several kinds of conditions randomly selected in advance.

4. A game machine, comprising:

random selection means for randomly selecting a plurality of game result conditions of a plurality of games, including a first game and at least one subsequent game, from among a plurality of possible game result conditions; and demonstration means for demonstrating that there is a "Second Game Win" condition among the plurality of game result conditions associated with the first game wherein said "Second Game Win" corresponds to a free game.

5. A game machine comprising:

random selection means for randomly selecting, at the beginning of the game, game result conditions for a predetermined number of games, including a first game and at least one subsequent game, from among a plurality of given game result conditions;

storage means for storing game result conditions selected for the predetermined number of games;

actuating means for actuating the start of a game;

determination means for determining whether the game result conditions randomly selected for the predetermined number of games include a "Second Game Win" game result condition associated with the first game corresponding to a free game; and demonstration means for indicating a higher probability of obtaining a "Second Game Win" game result in the game when said randomly selected game result conditions include said "Second Game Win" game result condition as one of said plurality of game result conditions.

6. A game machine according to claim 5, further comprising:

bonus game play means for allowing a player to play a second game without requiring the player to enter additional tokens after a "Second Game Win" condition has been obtained in the first game.

7. A game machine, comprising:

result selection means for randomly selecting game result conditions for a plurality of games including a current game and at least one subsequent game;

determining means for determining whether the results selected by said result selection means include at least a predetermined "Second Game Win" game result corresponding to a free game; and demonstration means, responsive to said determining means, for indicating when the "Second Game Win" game result is included in the results selected by said result selection means.

8. A game machine according to claim 7, wherein said result selection means selects a plurality of sets of randomly selected game results for the plurality of games, and then selects one result from the plurality of sets of randomly selected game results as the result for the current game.

9. A game machine, comprising:

a main unit;

an actuator coupled to said main unit;

a result selector coupled to said main unit and having a random result selection component and a plurality of game result storage areas;

a demonstrator coupled to said main unit; and an activator coupled to said demonstrator and responsive to said result selector, whereby said activator activates said demonstrator when at least one of said game result storage areas contains a "Second Game Win" game result corresponding to a free game.

10. A game machine according to claim 9, wherein said demonstrator includes at least one light.

11. A game machine according to claim 9, wherein said demonstrator includes at least one speaker.

12. A method of playing a game, comprising:

randomly selecting game results for a plurality of games for a current game and at least one subsequent game; and demonstrating when the randomly selected game results include at least one "Second Game Win" game result corresponding to a free game from said game results for the current game and at least one subsequent game.

13. A method according to claim 12, further comprising: storing the randomly selected game result conditions before demonstrating.

14. A method according to claim 12, further comprising: starting the game after storing the randomly selected game result conditions.

15. A method according to claim 12, further comprising: starting the game before storing the randomly selected game result conditions.

16. A method according to claim 12, wherein randomly selecting game results for a plurality of games includes selecting a plurality of sets of randomly selected game results and selecting a game result for the current game from the plurality of sets.

17. A method according to claim 12, wherein randomly selecting game result conditions for a plurality of games includes selecting a plurality of sets of randomly selected game result conditions and randomly selecting a game result for the current game from the plurality of sets.

18. A method according to claim 12, further comprising: starting the game by placing at least one token in at least one slot.

19. A method according to claim 12, wherein demonstrating includes indicating when the randomly selected game results include a "Second Game Win" game result and an additional predetermined game result.

20. A game machine comprising:

random selection means for randomly selecting a plurality of game result conditions of a plurality of games corresponding to a first game and at least one subsequent game;

storage means for storing said plurality of game result conditions for a predetermined number of games;

determining means for determining whether a "Second Game Win" condition is one of said plurality of game result conditions indicating a free game; and demonstration means for demonstrating that there is a "Second Game Win" condition among the plurality of game result conditions.

21. The game machine of claim 20, further comprising:

actuating means for actuating a start of a game.

22. The game machine of claim 21, further comprising:

bonus game play means for allowing a player to play a second game without requiring the player to enter additional tokens after a "Second Game Win" condition has been obtained in a first game.

23. The game machine of claim 20, wherein said demonstration means includes at least one light.

24. The game machine of claim 20, wherein said demonstration means includes at least one speaker.

25. The game machine of claim 20, wherein said determining means is first determining means, and the game machine further comprising:

second determining means for determining whether one of said plurality of game result conditions indicates another game result condition; and wherein said demonstration means, coupled to said first determining means and said second determining means, is activated when it has been determined that there is a "Second Game Win" condition or said other game result condition.

26. The game machine of claim 25, wherein said another game result condition is one of: a "Big Jackpot", a "Small Jackpot", and a "One Shy" condition.

27. The game machine of claim 20, wherein one of said plurality of game result conditions is associated with a single game play.

28. The game machine of claim 20, wherein at least two of said plurality of game result conditions are associated with a single game play and the game machine further comprises:

means for selecting a first of said at least two plurality of game results conditions for said single game play.

29. A method of playing a game comprising:

randomly selecting a plurality of game result conditions of a plurality of games corresponding to a first game and at least one subsequent game;

storing said plurality of game result conditions for a predetermined number of games;

determining whether a "Second Game Win" condition is one of said plurality of game result conditions indicating a free game; and demonstrating that there is a "Second Game Win" condition among the plurality of game result conditions.

30. The method of claim 29, further comprising:

starting a game by placing at least one token in at least one slot.

31. The method of claim 30, further comprising:

playing a second game without entering additional tokens after a "Second Game Win" condition has been obtained in a first game.

32. The method of claim 29, wherein said demonstrating includes displaying at least one light.

33. The method of claim 29, wherein said demonstrating includes using at least one speaker.

34. The method of claim 29, further comprising:

determining whether one of said plurality of game result conditions indicates another game result condition; and demonstrating that said other game result condition is one of the plurality of game result conditions.

35. The method of claim 34, wherein said another game result condition is one of: a "Big Jackpot", a "Small Jackpot", and a "One Shy" condition.

36. The method of claim 29, further comprising:

associating a single one of said plurality of game result conditions with a single game play.

37. The method of claim 29, further comprising:

associating at least two of said plurality of game result conditions with a single game play; and selecting a first of said at least two plurality of game results conditions for said single game play.

* * * * *